US005264671A

United States Patent [19]

Pham et al.

[11] Patent Number: 5,264,671

[45] Date of Patent: Nov. 23, 1993

[54] VARISTOR INSERTER DEVICE FOR A HIGH-VOLTAGE CIRCUIT-BREAKER

[75] Inventors: Van Doan Pham, Meyzieu; Michel Perret, Bourgoin Jallieu; Joseph Martin, Meyzieu, all of France

[73] Assignee: GEC Alsthom SA, Paris, France

[21] Appl. No.: 886,191

[22] Filed: May 21, 1992

[30] Foreign Application Priority Data

May 22, 1991 [FR] France ..... 91 06159

[51] Int. Cl.[5] ..... H01H 33/16; H01H 9/42

[52] U.S. Cl. ..... 200/148 R; 200/144 AP

[58] Field of Search ..... 200/144 AP, 148 R, 148 A, 200/150 G

[56] References Cited

U.S. PATENT DOCUMENTS 4,644,118 2/1987 Gengenbach et al. ..... 200/144 R
5,164,559 11/1992 Pham et al. ..... 200/144 AP

FOREIGN PATENT DOCUMENTS 0050341 4/1982 European Pat. Off. .
2459861 5/1976 Fed. Rep. of Germany .
1178324 1/1970 United Kingdom .
2032180 4/1980 United Kingdom .

*Primary Examiner*—A. D. Pellinen
*Assistant Examiner*—Michael A. Friedhofer
*Attorney, Agent, or Firm*—Sughrue, Mion, Zinn, Macpeak & Seas

[57] ABSTRACT

A device for temporarily inserting an electrical component such as a varistor connected to a contact arm carrying a metal contact ring in parallel with the contact of a circuit-breaker comprises a small diameter metal tube mechanically joined and electrically connected to the exterior of the main mobile contact. A rod can slide inside the small diameter metal tube. The rod has at a first end, a metal contact sleeve which can come into electrical contact with the metal contact ring. The sleeve abuts a first end of the small diameter metal tube. The second end of the rod carries a conical abutment. The second end of the tube has a bore which terminates in a conical interior shape profile complementary to and sized to that of the abutment.

7 Claims, 3 Drawing Sheets

VARISTOR INSERTER DEVICE FOR A HIGH-VOLTAGE CIRCUIT-BREAKER

BACKGROUND OF THE INVENTION

1. Field of the Invention

The present invention concerns a device for connecting a varistor or a resistor or an arrangement comprising a resistor and a varistor in parallel with the contacts of a circuit-breaker when the latter is opened and closed, the varistor or the resistor or the arrangement thereof being disposed inside the casing containing the interrupting chamber of the circuit-breaker.

2. Description of the Prior Art

British patent application 2 032 180 discloses a circuit-breaker comprising, inside the interrupting chamber, auxiliary contacts for inserting a capacitor into the circuit for a limited period after the contacts of the circuit-breaker separate. To this end a hook retains the auxiliary contacts against the action of a compressed spring; retraction of the hook releases the spring which opens the auxiliary contacts. At the end of the maneuver the spring is compressed again by an arm joined to the main mobile contact of the circuit-breaker.

A device of this kind is bulky and complex, which increases the cost of the equipment because of the need to increase greatly the volume of the interrupting chamber; a device of this kind is heavy and increases the energy required to operate the circuit-breaker; a device of this kind includes a spring which is compressed when the circuit-breaker is open, with the risk of unintentional closure of the device, which severely compromises safety.

An object of the invention is to provide a simple device adapted to be installed on existing circuit-breakers without significantly increasing their unit cost and, in particular, adapted to be accommodated in the casing of the interrupting chamber without increasing its size; another object of the invention is to provide a lightweight device which does not require any increase in the circuit-breaker operating energy; another object of the invention is to provide a device in which the spring is relaxed when the circuit-breaker is open, which enhances the safety of the device.

Another object of the invention is to provide a device enabling component insertion for a sufficient time after the arc contacts separate when the circuit-breaker opens to reduce effectively the breaking voltage surge.

The device necessarily comprises two contacts which separate after insertion; another object of the invention is to provide an inserter device which, after the insertion time, effects fast de-insertion in such a way as to interrupt the residual arc without difficulty.

Another object of the invention is to provide an inserter device which, despite relative displacement of its component parts at high speeds, includes damper means to prevent any jerkiness of operation.

Another object of the invention is to provide a device enabling component insertion when the circuit-breaker opens and also, if the user requires, when the circuit-breaker closes.

SUMMARY OF THE INVENTION

The invention consists in a device for temporarily inserting an electrical component selected from a resistor, a varistor, a capacitor or any combination of said components in parallel with the contacts of a circuit-breaker at the start of opening or at the start of closing of said circuit-breaker, said circuit-breaker comprising inside said chamber said electrical component connected firstly to a first terminal and secondly to at least one contact arm carrying a contact ring, which device comprises, for each phase, at least one interrupting chamber comprising a gas-tight insulative casing filled with a gas having good insulative properties and comprising inside it a fixed main contact connected to said first terminal and a fixed arc contact and a mobile assembly comprising a mobile main contact connected to a second terminal, a mobile arc contact and an operating link, a metal tube mechanically joined and electrically connected to said main mobile contact, and a rod adapted to slide inside said tube and comprising at a first end a metal contact tube adapted to come into electrical contact with said ring, said sleeve abutting a first end of said tube, the second end of said rod being provided with a conical abutment, the second end of said tube having inside it a conical shape complementary to that of said abutment, a conductive material spring being disposed inside said tube and around said rod between the first end of said tube and the second end of said rod, and said spring being relaxed when said circuit-breaker is in an armed or tripped rest position.

The abutment advantageously carries an O-ring and is made from polytetrafluoroethylene.

In one embodiment of the invention the end of the contact sleeve near the contact arm is made from a metal impregnated with a product adapted to release a gas due to the effect of the electrical arc.

In an embodiment applicable to grounded metal casing circuit-breakers the contact arm is in the form of a tube provided at one end with contact fingers and provided with a bulkhead to delimit a gas blast volume, an insulative nozzle surrounding the contact fingers.

The invention is explained by way of a description of various embodiments of the invention given with reference to the appended drawings.

DETAILED DESCRIPTION OF THE INVENTION

Figure 1:
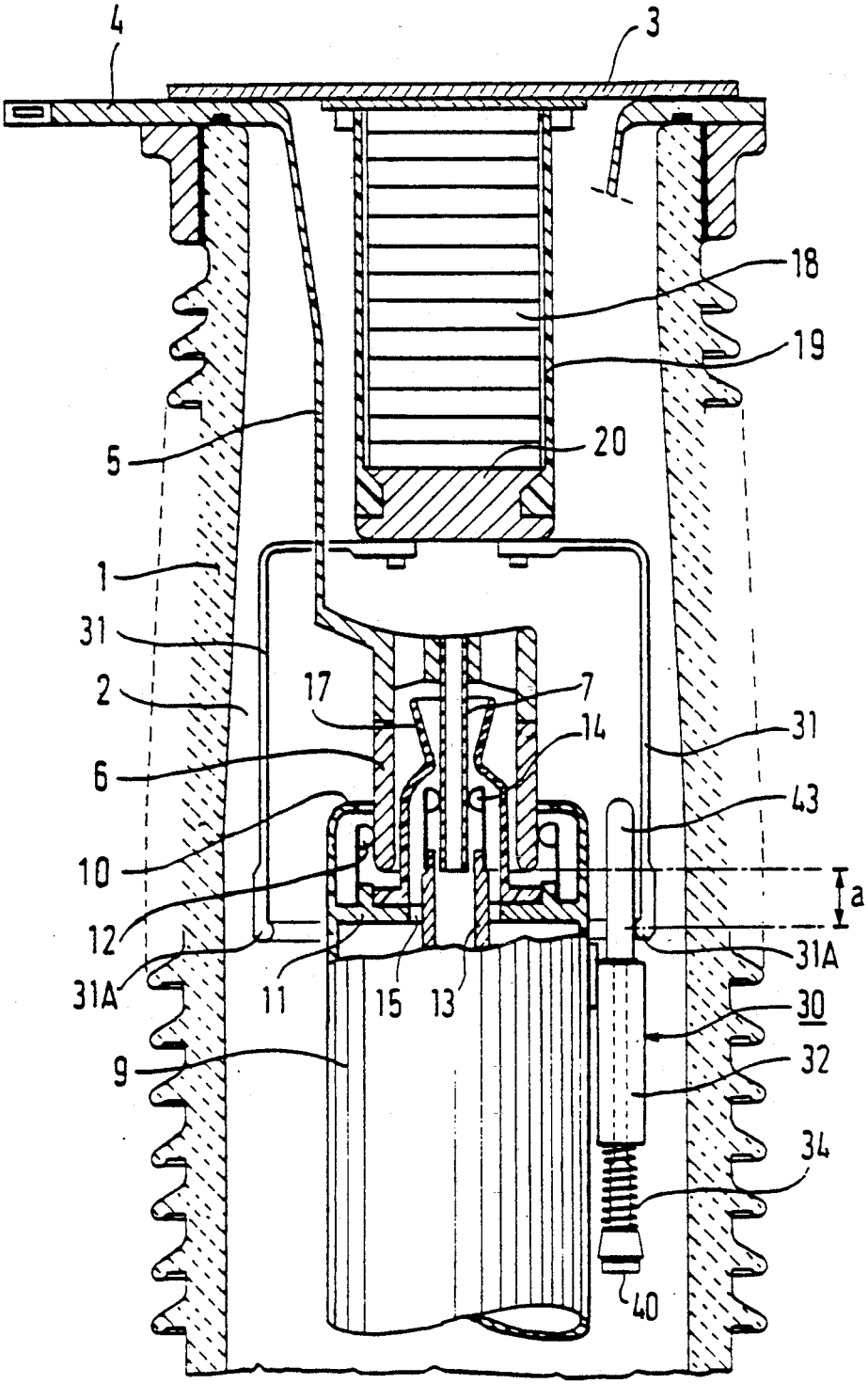
FIG. 1 is a partial view in axial cross-section of an interrupting chamber in a first embodiment of the invention with a varistor inside said chamber and a device for inserting said varistor.

Referring to FIG. 1, an insulative casing 1, preferably of porcelain, delimits a volume 2 containing the interrupter devices of the circuit-breaker. The insulative casing is closed at one end by a metal plate 3 fixed to a metal ring 4 constituting a first terminal and is extended inside the casing by arms 5 to which are fixed a first metal tube 6 constituting a fixed main contact and a second tube 7 coaxial with the first and constituting a fixed arc contact.

The volume 2 is filled with a gas having good insulative properties such as sulfur hexafluoride at a pressure of a few bars.

The mobile assembly of the circuit-breaker comprises a metal tube 9 extended by an anti-discharge cap 10 and provided with a transverse metal bulkhead 11 carrying contact fingers 12 constituting a mobile main contact and a gas blast tube 13 extended by contact fingers 14 constituting a mobile arc contact. The bulkhead 11, which incorporates holes for the gas blast to pass through, carries an insulative material gas blast nozzle 17. The gas blast is provided by a fixed piston disposed inside the tube 9 (not shown in FIG. 1). The tube 9 is connected by sliding contacts (not shown) to a second terminal of the circuit-breaker.

A varistor is disposed inside the volume 2. It comprises a stack of disks 18 in an insulative tube 19 fixed at one end to the plate 3 and closed at the other end by a metal block 20.

As an alternative to this, the varistor may be associated with a plurality of resistor elements; the invention applies equally well to circuit-breakers in which there are only resistor elements. To simplify the following description, reference will be made only to an interrupting chamber containing a varistor, although it is to be understood that the invention applies to any circuit-breaker in which an electrical component (varistor, resistor, capacitor or any combination thereof) must be inserted into the circuit when the circuit-breaker is opened and/or closed.

The inserter device 30 in accordance with the invention shown in FIG. 1 cooperates with a contact in the form of arms 31 fixed to the metal block 20 and carrying a metal contact ring 31A.

Figure 2A:
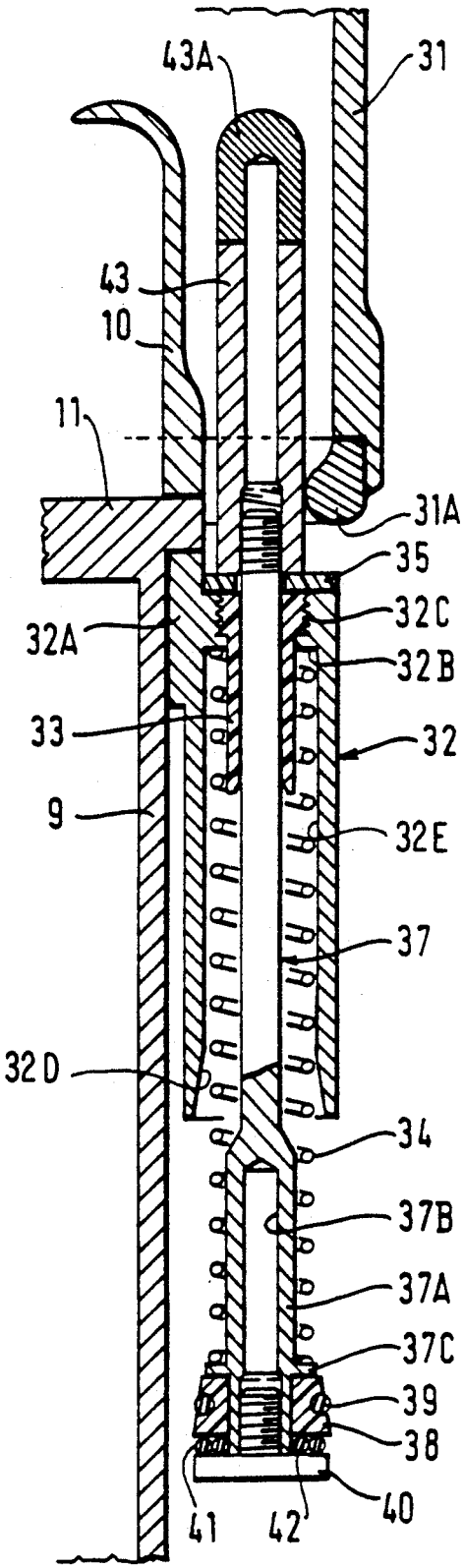
FIGS. 2A and 2B are enlarged views of the inserter device in axial cross-section and respectively in a position representing the closed state of the circuit-breaker and in a position during opening of the circuit-breaker.
Figure 2B:
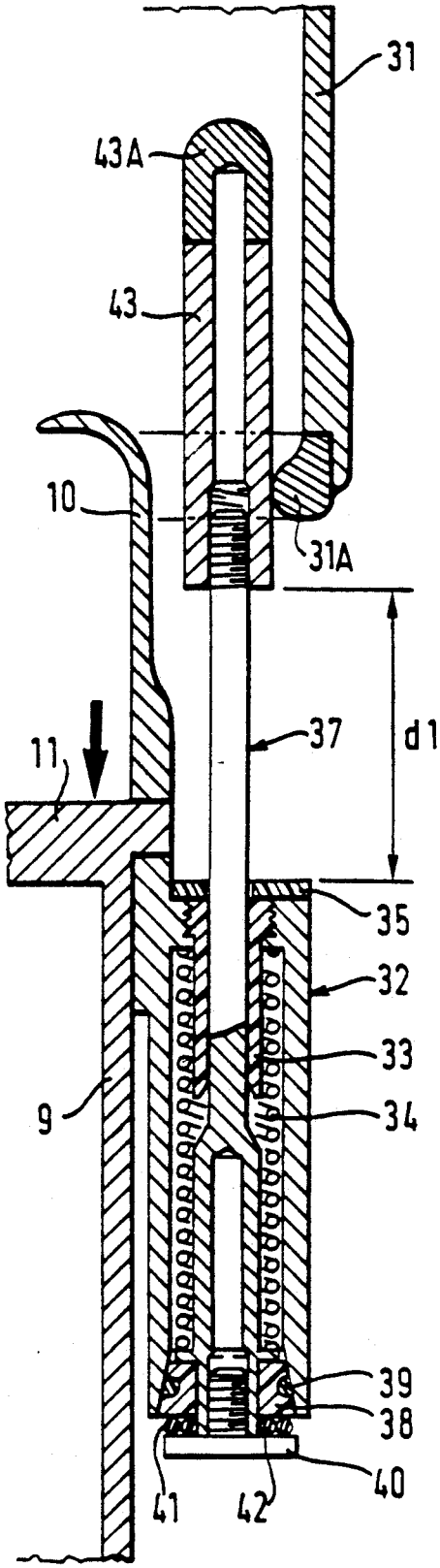

FIGS. 2A and 2B show in detail one embodiment of the inserter device.

The inserter device comprises a metal tube 32 having a projection 32A by which the tube is fixed mechanically and connected electrically to the tube 9, by brazing, for example. Inside the tube is an insulative bush 33 of PTFE, for example. The bush 33 and the tube 32 define a housing accommodating a first end of a spring 34 which bears against a shoulder 32B on the inside of the tube 32. The bush 33 is screwed to the tube 32 adjacent the shoulder 32C. An insulative washer 35 is adhesively bonded to the upper end of the tube 32. The lower end 32D of the tube bore 32E has a conical shape internal profile whose function will be explained later.

Inside the bush 33 slides a rod 37 of high-tensile brass, for example, ending in a larger diameter portion 37A containing a screwthreaded bore 37B. Towards the lower end of the portion 37A, a radial collar 37C forms an abutment which supports the second end of the spring 34. To the lower end of the portion 37A is fitted a conical abutment or ring 38 with a conical outside profile, preferably made from polytetrafluoroethylene and provided with an O-ring 39 within its periphery. The abutment 38 is held in place by the head of a screw 40 screwed into the bore 37B with O-rings 41 and 42 between the head of the screw 40 and the abutment 38.

A contact sleeve 43, advantageously of copper, is screwed to the upper part of the rod 37.

The device operates as follows:

When the circuit-breaker is closed (FIGS. 1 and 2A) the contact sleeve 43 is in contact with the metal contact ring 31A and the varistor is short-circuited by the main contacts and the arc contacts. The spring 34 is relaxed.

When the circuit-breaker is opened the mobile assembly is drawn downwardly (as seen in FIG. 2B), and the entrained tube 32 which compresses the spring 34. Because of the inertia of the rod 37 and of the contact sleeve 43, the latter remain immobile so that the varistor is inserted into the circuit of the circuit-breaker after the arc contacts 7 and 14 separate. The current then flows through the contact arm 31, the metal contact ring 31A, the contact sleeve 43, the rod 37, the spring 34, the tube 32 and the tube 9. The spring is advantageously made from beryllium copper.

When the spring is fully compressed (as shown in FIG. 2B) the rod 37 is entrained which separates the contact sleeve 43 and the metal contact ring 31A and consequently de-inserts the varistor.

When the mobile assembly of the circuit-breaker is immobilized the relaxing of the spring returns the rod 37 to its initial position relative to the tube 32.

Because the conical part of the tube 32 engages with the conical ring 38, these two members having conjugate complementary shapes, the rod is entrained without jerkiness.

It is possible to size the device to adjust the time for which the varistor is inserted when the circuit-breaker is opened; two parameters govern this time:

firstly, the distance d1 over which the tube 32 is displaced before its entrains the rod 32 (FIG. 2B), secondly, the distance a between the metal contact ring 31A and the end of the tube 7 (FIG. 1). The smaller the distance a, the greater is the required distance d1.

The device can also insert the varistor into circuit when the circuit-breaker is closed. All that is required is for the end of the contact sleeve 43 to come into contact with the metal contact ring 31A before the arc contacts 7 and 14 engage. The distance a determines the closing insertion time which is usually in the order of 8 ms. If, when at rest, the end of the mobile arc contact 14 and the end 43A of the contact sleeve 43 are at the same level, and if the distance a is zero, the varistor cannot be inserted into circuit when the circuit-breaker is closed.

When the metal contact sleeve 43 and the contact ring 31A separate an arc is produced; this is more easily extinguished if the end 43A of the contact sleeve 43 is made from a metal impregnated with a product adapted to release a gas such as fluorine due to the action of the arc. A product based on metal powder impregnated with polymer marketed under the trade name FULMEX may be used, for example.

Figure 3:
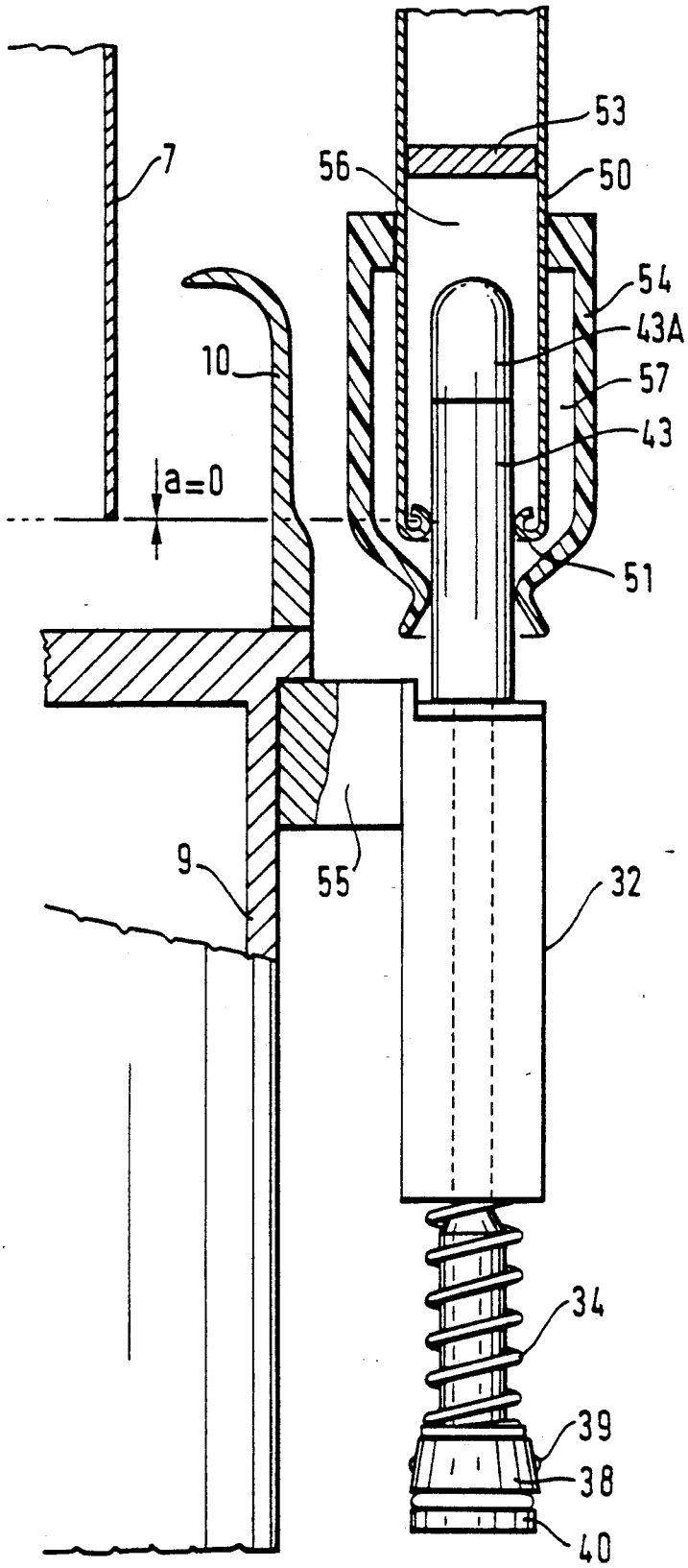
FIG. 3 is a view in axial cross-section of another embodiment of inserter device in accordance with the invention.

FIG. 3 shows a different embodiment of the device advantageously usable with grounded metal casing circuit-breakers in which a relatively large space is provided around the interrupter devices. In this embodiment, where elements common to the previous figures and FIG. 3 are identified by the same reference numbers, the contact arms 31 are replaced by a metal tube 50 ending in contact fingers 51. The metal tube 50 has a back or internal partition 53 so that its interior volume 56 constitutes a gas blast volume for blowing out the arc which is established when the fingers 51 and the contact sleeve 43 separate. An insulative material, nozzle 54 of polytetrafluoroethylene, for example, nozzle 54 channels the gas blast.

The metal tube 32 of the device is fixed to the mobile tube 9 by an arm 55. In this embodiment, in which the distance a is equal to zero, there is no insertion of a varistor into circuit when the circuit-breaker closes.

It is also possible to dispense with the back 53 and to use the volume 57 as a thermal expansion and gas blast volume. In this case a double gas blast is produced with gas flowing upwards through the metal tube 50 and downwards through the neck of the nozzle 54.

The invention applies to conventional type high-voltage circuit-breakers with a ceramic casing or to the type with a grounded metal casing.

There is claimed:

1. Device for temporarily inserting an electrical component selected from a resistor, a varistor, a capacitor or any combination of said components in parallel with the contacts of a circuit-breaker including at least one interrupting chamber at the start of opening or at the start of closing of said circuit-breaker, said circuit-breaker comprising; inside said interrupting chamber, said electrical component connected firstly to a first terminal and secondly to at least one contact arm carrying a metal contact ring, said device, for each phase, comprising a gas-tight insulative casing defining said at least one interrupting chamber, filled with a gas having good insulative properties and comprising inside said chamber, a fixed main contact connected to said first terminal and a fixed arc contact, and a mobile assembly comprising a mobile main contact connectable to a second terminal, a mobile arc contact and an operating link; a first, small diameter metal tube being fixed to the exterior of said main mobile contact and movable therewith, and a rod slidably mounted inside said first, small diameter metal tube and comprising at a first end, a metal contact sleeve adapted to come into electrical contact with said metal contact ring, said metal contact sleeve abutting a first end of said first, small diameter metal tube, a second end of said rod being provided with a conical abutment, a second end of said first small diameter metal tube terminating interiorly in a conical shape profile complementary to that of said abutment and being sized thereto, a conductive material spring being disposed inside said first, small diameter metal tube and concentrically about said rod and having opposite ends abutting respectively, the first end of said first small diameter metal tube and a second end of said rod, and said spring being relaxed when said circuit-breaker is in an armed or tripped, rest position.

2. Device according to claim 1 wherein said spring is guided at one end by an insulative bush coaxial to said first small diameter metal tube.

3. Device according to claim 1 wherein said abutment having a conical external profile carries an O-ring.

4. Device according to claim 1 wherein said abutment is made from polytetrafluoroethylene.

5. Device according to claim 1 wherein the end of said contact sleeve is made from a metal impregnated with a product adapted to release an insulative gas due to the effect of the electrical arc.

6. Device according to claim 1 wherein said contact arm is in the form of a second, small diameter metal tube provided at one end with contact fingers and provided with a bulkhead for delimiting a gas blast volume, and an insulative nozzle surrounding said contact fingers.

7. Device according to claim 1 wherein the distance over which said first, small diameter metal tube is displaced before it entrains said rod is determined in such a way as to achieve a varistor insertion time on opening in the order of eight milliseconds.

* * * * *